US006073406A

United States Patent [19]

Kearney

[11] Patent Number: 6,073,406

[45] Date of Patent: Jun. 13, 2000

[54] CORNER BEADS

[76] Inventor: Raymond Kearney, 20 Ossie Court, Parkwood, Queensland 4214, Australia

[21] Appl. No.: 09/026,765

[22] Filed: Feb. 20, 1998

[30] Foreign Application Priority Data

Feb. 20, 1997 [AU] Australia ..... PO 5222

[51] Int. Cl.[7] ..... E04B 2/00

[52] U.S. Cl. ..... 52/287.1; 52/716.1; 52/717.03; 52/717.04; 52/717.05

[58] Field of Search ..... 52/716.1, 717.03, 52/717.04, 717.05, 717.06, 287.1, 288.1, 731.7, 733.2

[56] References Cited

U.S. PATENT DOCUMENTS

| | | | |
|---|---|---|---|
| 2,643,423 | 6/1953 | Brendel . | |
| 2,851,741 | 9/1958 | Stemples | 52/255 |
| 2,904,865 | 9/1959 | Robinson . | |
| 3,090,187 | 5/1963 | Miller | 52/287.1 |
| 3,109,207 | 11/1963 | Cooper | 52/287.1 X |
| 3,156,599 | 11/1964 | Keesee | 52/717.04 X |
| 4,835,925 | 6/1989 | Hoffmann, Sr. | 52/287.1 |
| 4,852,318 | 8/1989 | Anderson | 52/717.05 X |
| 5,131,198 | 7/1992 | Ritchie et al. | 52/287.1 |
| 5,330,814 | 7/1994 | Fewell | 52/717.03 X |
| 5,442,886 | 8/1995 | Iacobelli | 52/287.1 X |
| 5,475,953 | 12/1995 | Greenfield | 52/717.03 X |

FOREIGN PATENT DOCUMENTS

| | | | |
|---|---|---|---|
| 4027116 | 2/1992 | Germany | 52/716.1 |

*Primary Examiner*—Beth A. Aubrey
*Assistant Examiner*—Brian E. Glessner
*Attorney, Agent, or Firm*—Klauber & Jackson

[57] ABSTRACT

A corner bead assembly for mounting across a corner of a wall includes a substantially rigid elongate body. The body has front and rear faces and defines a reference bead and flanges positioned on each side of the reference bead. The flanges extend outwardly away from the reference bead to terminal edges defining sides ot the body. At least one of the flanges is offset. A rear layer of a flexible material is mounted over the rear face of he body. The rear layer extends beyond the terminal edge of the offset flange. A front layer of a flexible material is mounted over the offset flange and extends outwardly beyond the terminal edge of the offset flange. The offset flange is sandwiched between the front and rear layers of flexible material and the front and rear layers of flexible material are adhered to each other past the terminal edge of the offset flange. The corner bead assembly includes an adhesive for adhering the front and rear layers of flexible material to each other and to the offset flange.

10 Claims, 18 Drawing Sheets

CORNER BEADS

TECHNICAL FIELD

This invention relates to corner beads for making internal and external corners in structures using wall boards such as plasterboard.

BACKGROUND ART

Corner beads are well known. A typical corner bead is made of metal and takes the form of opposed elongated side flanges extending laterally from each side of an elongated central bead which forms a reference from which a filling compound such as plaster may be trowelled to cover the side flanges. Such corner beads are normally applied by positioning the back face of the corner bead against the panels forming the corner and attaching the flanges to the wall. Typically this is achieved by utilising either of two main attachment methods, and then finishing/securing with the use of filling compound to finish the joint.

The first attachment method uses nails to attach the flanges to the wall and the second attachment method uses paper tape and the filling compound to attach the flanges to the wall.

One known corner bead which is disclosed in U.S. Pat. No. 2,643,423 describes a metal corner bead for an external wall junction. The corner bead flanges are provided with perforations to receive nails for securing the flanges to the wall. Additionally, a separate strip of perforated flexible tape spans over the outer face of each flange and the joint between the outer edge of each flange and the wall, and the flexible tape is secured in position by filling compound.

Another known corner bead which is disclosed in U.S. Pat. No. 2,904,856 also discloses a metal corner bead for an external wall junction in which the flanges are also provided with perforations. Additionally, a separate L-shaped strip of perforated paper, which extends beyond the flange outer edges, is sandwiched between the inner face of the corner bead and the wall. The components are positioned so that the perforations in the corner bead register with the perforations in the paper and are of sufficient size to receive filling compound thus forming binding posts to anchor the flanges to the wall.

There are a number of problems of prior art corner beads and their application or fixing to wall components. These problems relate to:

- the amount of time taken and the degree of skill required to apply the corner beads;
- the visual appearance of the corner beads after finishing;
- the poor adhesion and thus lack of strength. For example, poor adhesion between metal or plastics and plaster components;
- protruding jointing compound in the vicinity of the perforations;
- the covering of the nail heads;
- the damage to the paper where a paper layer extends over the outer face of the bead portion of the corner bead, and
- the exposure of metal flange parts which can result in cracking.

It is an object of this invention to alleviate at least one of the above disadvantages and/or to provide a useful alternative to known corner beads and their method of application, which will be reliable and efficient in use.

DISCLOSURE OF INVENTION

With the foregoing and other objects in view, the invention in one aspect resides broadly in a corner bead assembly for attachment to a wall corner or the like and including:

- an elongate body structure providing an elongate reference bead assembly providing a reference face or opposed reference faces and a respective offset flange extending from each of the opposite sides of said reference bead assembly and offset rearwardly from the reference face or a respective one of said reference faces;
- a back layer of flexible material substantially covering the back face of said elongate body structure, and
- respective front layers of flexible material substantially covering the front face of each said flange and terminating at their inner edges near adjacent ones of said opposite sides.

The layers may terminate at the outer edges of the flanges but preferably the back layer and the front layers extend outwardly beyond the offset flanges and the respective front layers bond to corresponding outward extensions of the back layer. These bonded flexible outward extensions of the front and back layers further facilitate attachment of the corner bead to a wall or the like surface and enable close adherence to the overlapped wall panel surfaces.

More preferably one of the bonded flexible outward extensions of the front and back layers at each side of the elongate body structure extends outwardly beyond the other so as to provide an edge portion which is not stiffened by being bonded to another layer. Most preferably the front layers extends outwardly beyond the back layer so as to provide a continuous wide flexible front layer extending from said opposite sides.

The front and back layers of flexible material may be formed of any suitable material well known in the art, such as, for example a porous paper. The elongate body structure may be formed of any suitable material such as for example, plastics or metal, and the front and back layers as well as the elongate body structure are preferably free of perforations.

The flanges may extend from reference bead assembly at any convenient angle and the reference bead assembly may be of any convenient shape or cross-section.

In one embodiment of the invention the elongate body structure is formed from a flexible plastics material such as PVC and provides laterally opposed elongate front reference faces extending from a hinge line whereby the angular offset between the laterally opposed elongate front reference faces may vary from a substantially in-line attitude to an attitude forming an acute angle and/or an obtuse angle between the laterally opposed elongate front reference faces.

This arrangement has the advantage that one corner bead assembly may be used as an internal or external bead for various internal and external angles.

This arrangement also has the advantage that when the laterally opposed elongate front reference faces are substantially in-line with one another the corner bead assembly is substantially flat and can be rolled up about a transverse axis parallel to the corner bead assembly. This facilitates storage and transport and convenience of use.

In a further embodiment the bead assembly includes spaced elongate reference beads separated by a rearwardly extending and width adjustable body portion able to provide an expansion joint between spaced adjacent edges of wall panels.

In another aspect this invention may be utilised as an edge finishing assembly including:

- an elongate body structure providing an finishing edge having a reference face extending therealong;
- an offset flange extending from the elongate body structure opposite said finishing edge and offset rearwardly from the reference face;

a back layer of flexible material substantially covering the back faces of said elongate body structure and said offset flange, and a front layer of flexible material substantially covering the front face of said offset flange and terminating adjacent reference face.

The variations defined above for the front and back layers may also be applied to the single offset flange of the edge finishing assembly. Furthermore in one embodiment a further flange formed as a covering flange for an edge of a wall panel extends from the side of said elongate body structure opposite to said offset flange and at right angles thereto and suitably the back layer also extends across the back face of the further flange.

According to yet another aspect, this invention resides broadly in a method of applying the corner beads of this invention to a wall panel joint, including:

applying a filling compound to the rear face of the corner bead assembly and/or the front wall panel surfaces at the joint;

operatively locating the rear face of the corner against the front wall surfaces at the joint to adhere the corner bead in position with close adherence of the outer edges of the corner bead assembly to the overlapped wall panel surfaces, and trowelling a filling layer of filling compound over the opposed flanges using the exposed metal or plastics reference face or a respective one of said reference faces as a guide for the trowel or scraper.

BRIEF DESCRIPTION OF DRAWINGS

In order that the invention may be more easily understood and put into practical effect, reference will now be made to the accompanying drawings which illustrate preferred examples of the invention, wherein:

Referring to FIG. 1 a pre-fabricated external "L-type" edge finishing bead assembly 10 for attachment to a wall corner is provided with a reference bead 11, an offset flange 12 and a return flange 13 extending from respective sides of the reference bead 11. The edge bead assembly 10 is formed from any suitable metal or plastics material.

Figure 1:
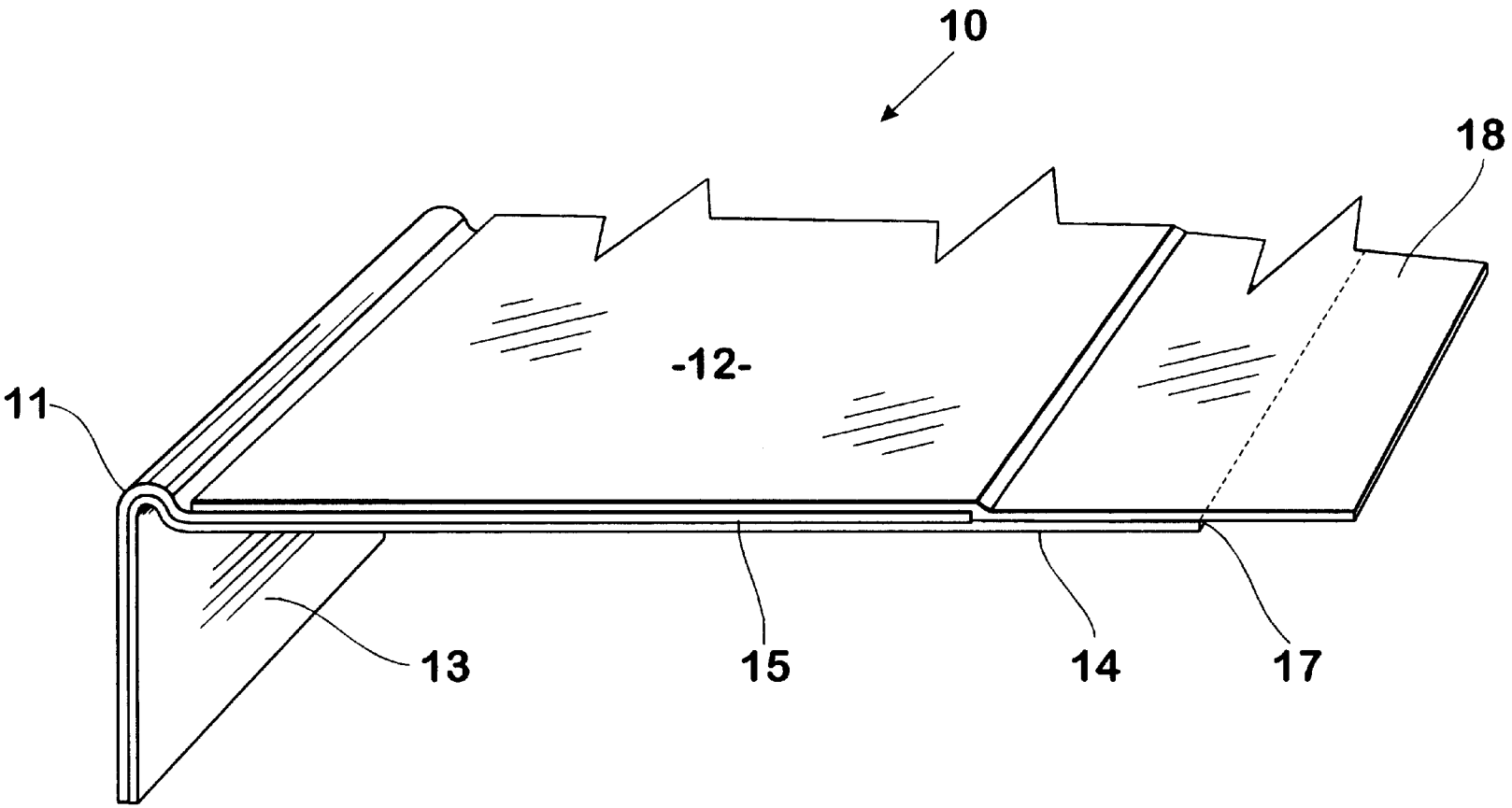
FIG. 1 is an end view of an edge finishing bead constructed in accordance with this invention.

A first paper layer 14 is bonded to the back face 15 of the edge bead assembly 10 and extends from the end of the flange 13 to an edge 17 beyond the flange 12. A second paper layer 18 is bonded to the front face of flange 12 and extends from the junction of the reference bead 11 and the flange 12 to a position beyond the edge 17 of first paper layer 14. Both the flanges and the paper layers are free of perforations.

Figure 2:
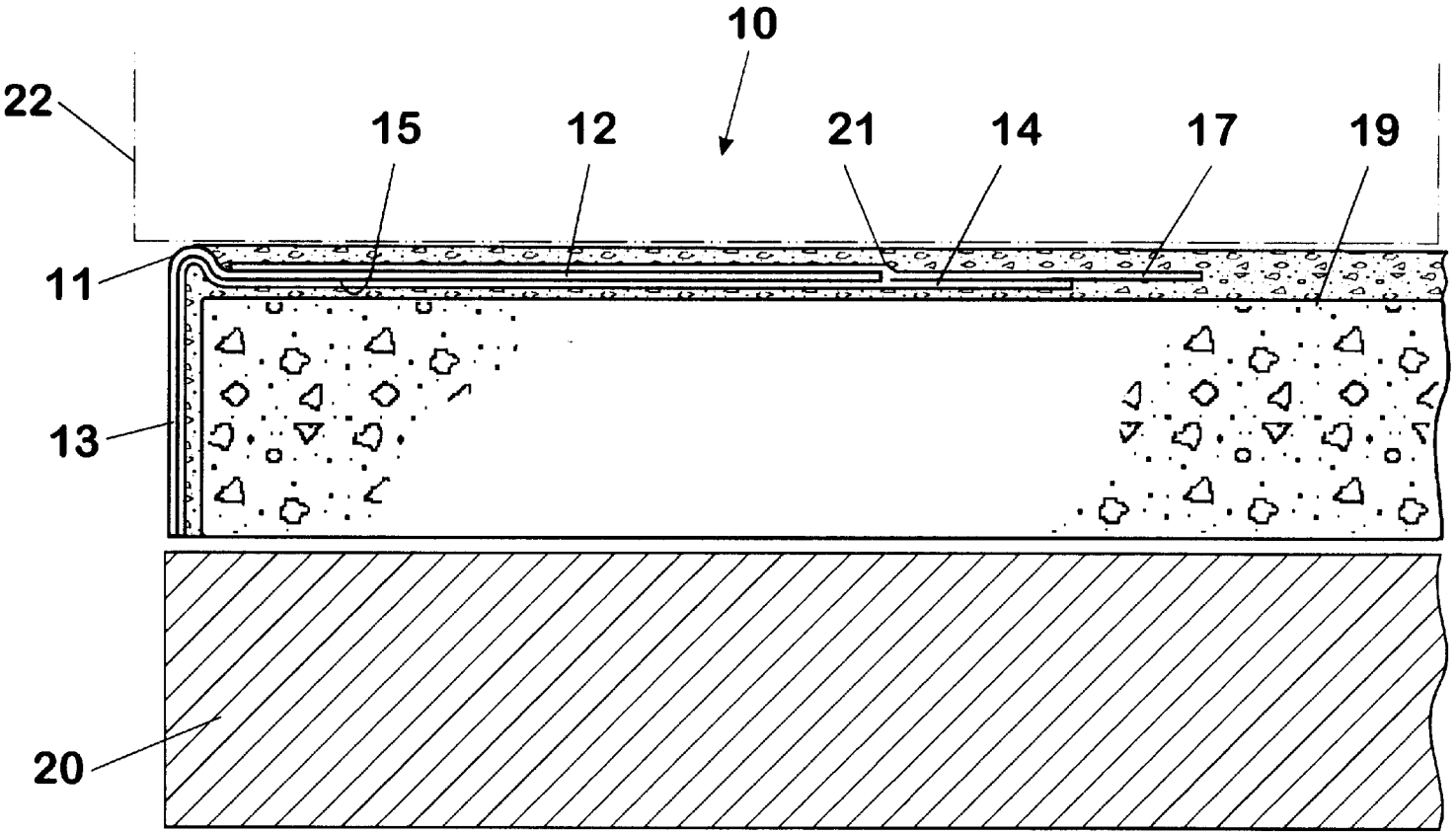
FIG. 2 is a sectional end view of the edge finishing bead of FIG. 1 in an in-use position.

Referring to FIG. 2, the finishing bead assembly 10 of FIG. 1 is shown applied to the edge of a plaster board 19 which is attached to a wall 20. A plaster filling compound 21 is applied either by hand to the plaster board 19 or by an applicator such as a trowel, knife or scraper to the edge bead assembly 10 itself as illustrated in ghost outline at 22.

The edge bead assembly 10 is placed with its back face towards the a plaster board 19 and a roller is then rolled over the edge bead assembly 10 to firmly attach it to the plaster board. A finishing knife located for running along the reference bead 11 is used to apply the final layer of filling compound 21 which is feathered to the panel as illustrated to complete the application of the corner bead, leaving the outer face 16 of the reference bead 11 and return flange 13 exposed, as illustrated by cross-hatching, for painting or application of other finishes.

Figure 3:
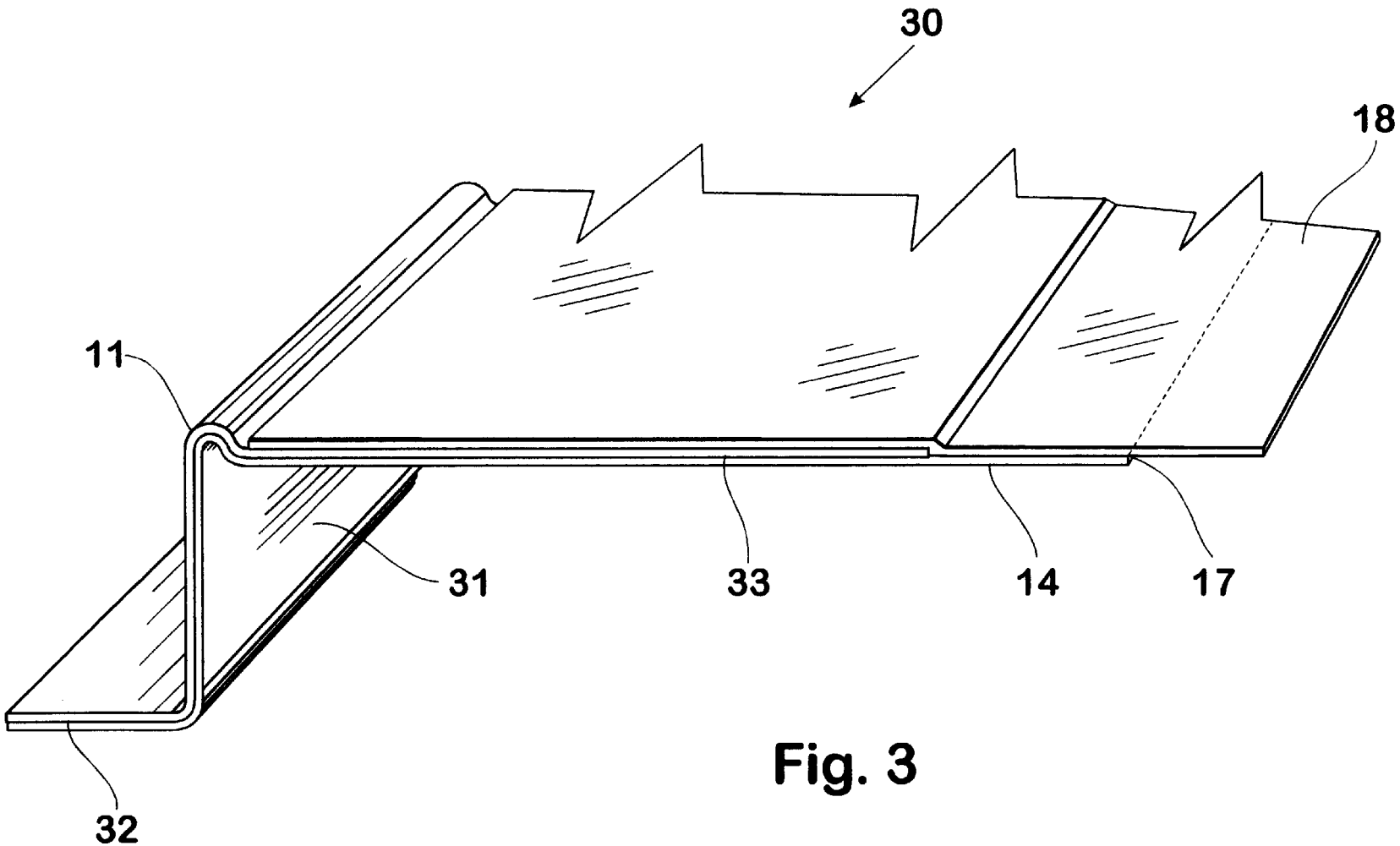
FIGS. 3 and 4 correspond to FIGS. 1 and 2 but illustrate an alternate form of edge finishing bead.
Figure 4:
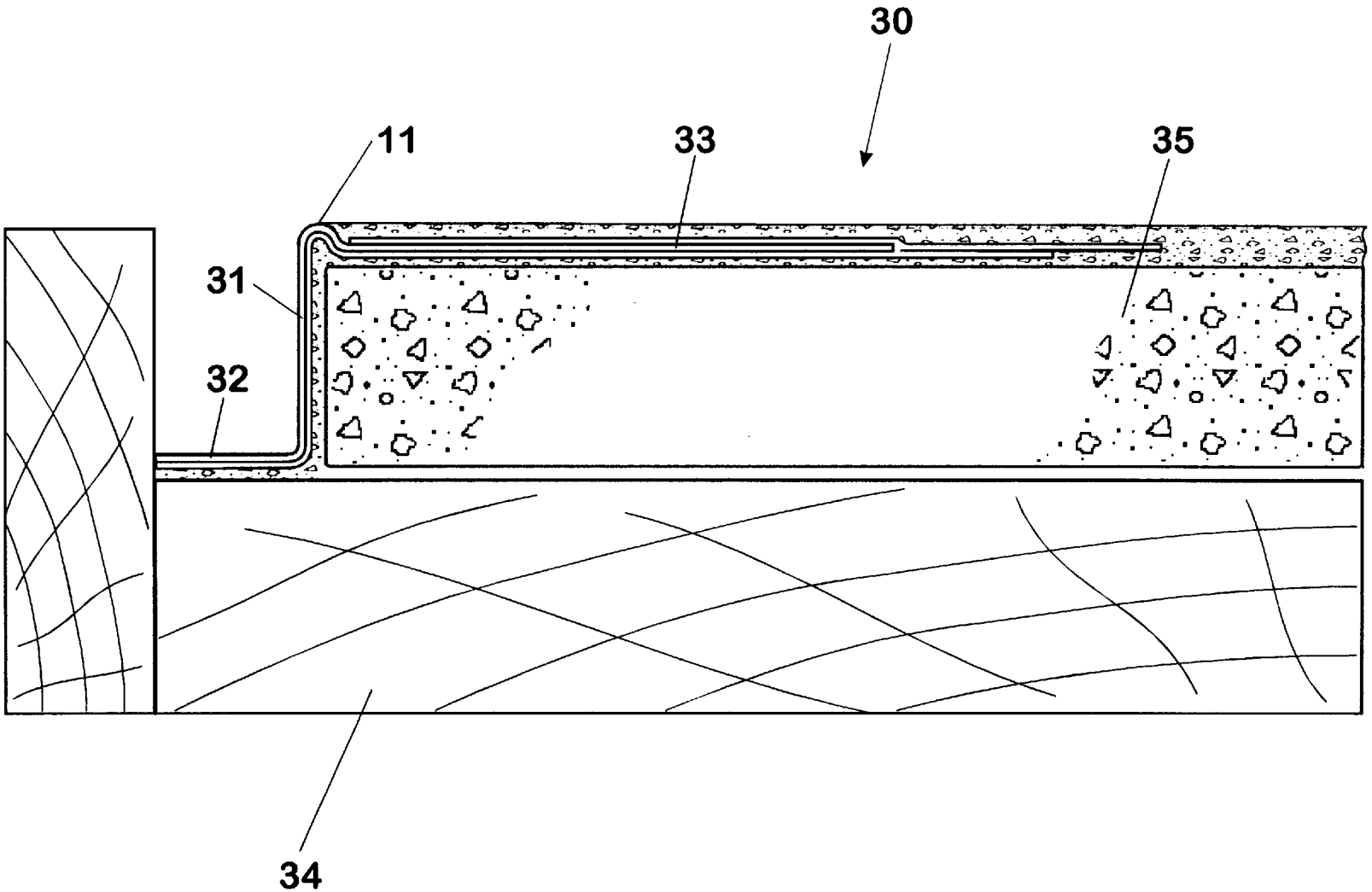

A variation of the edge bead assembly 30 is illustrated in FIG. 3. In this embodiment and in following embodiments like components may be given the same reference numerals for clarity and brevity. In this embodiment the return flange 31 has an extension flange 32 extending parallel to the offset flange 33. The extension flange 32 extends along the base wall 34 to which the plaster board 35 is attached.

Figure 5:
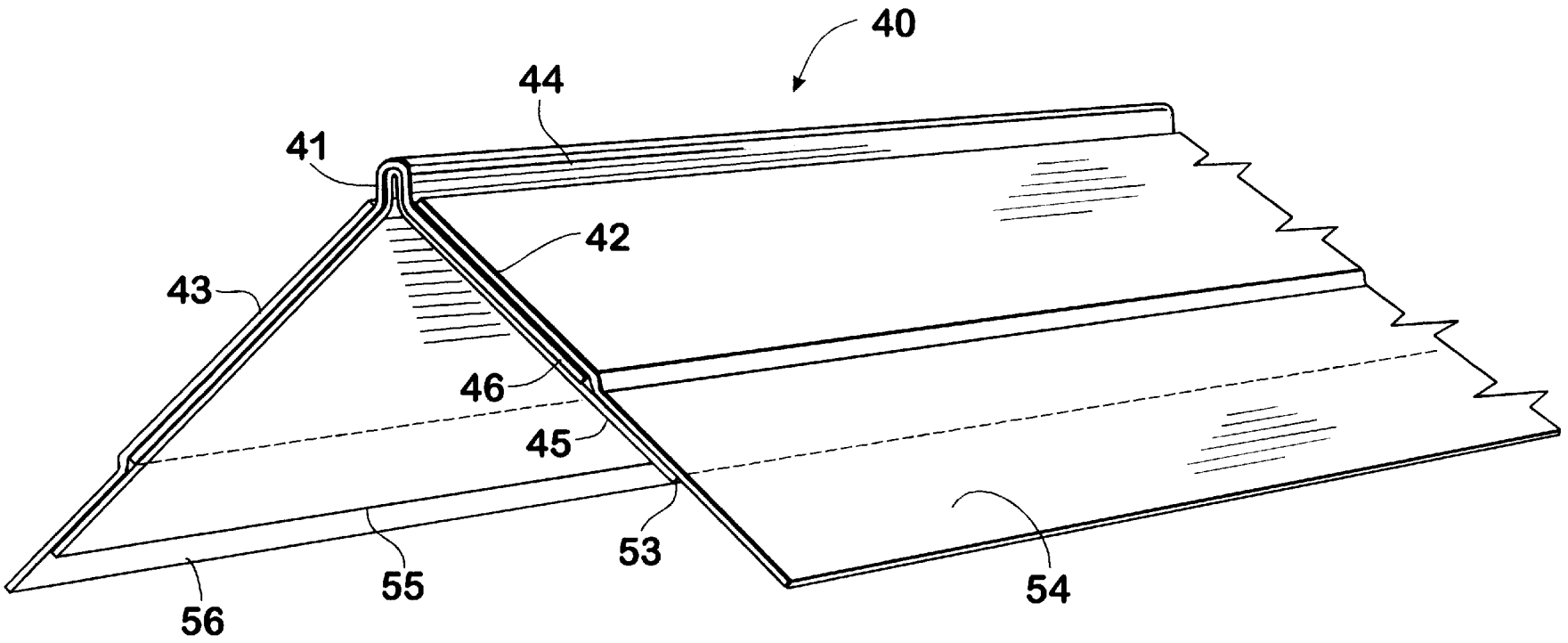
FIG. 5 is a perspective view of an external corner bead constructed in accordance with this invention.
Figure 6:
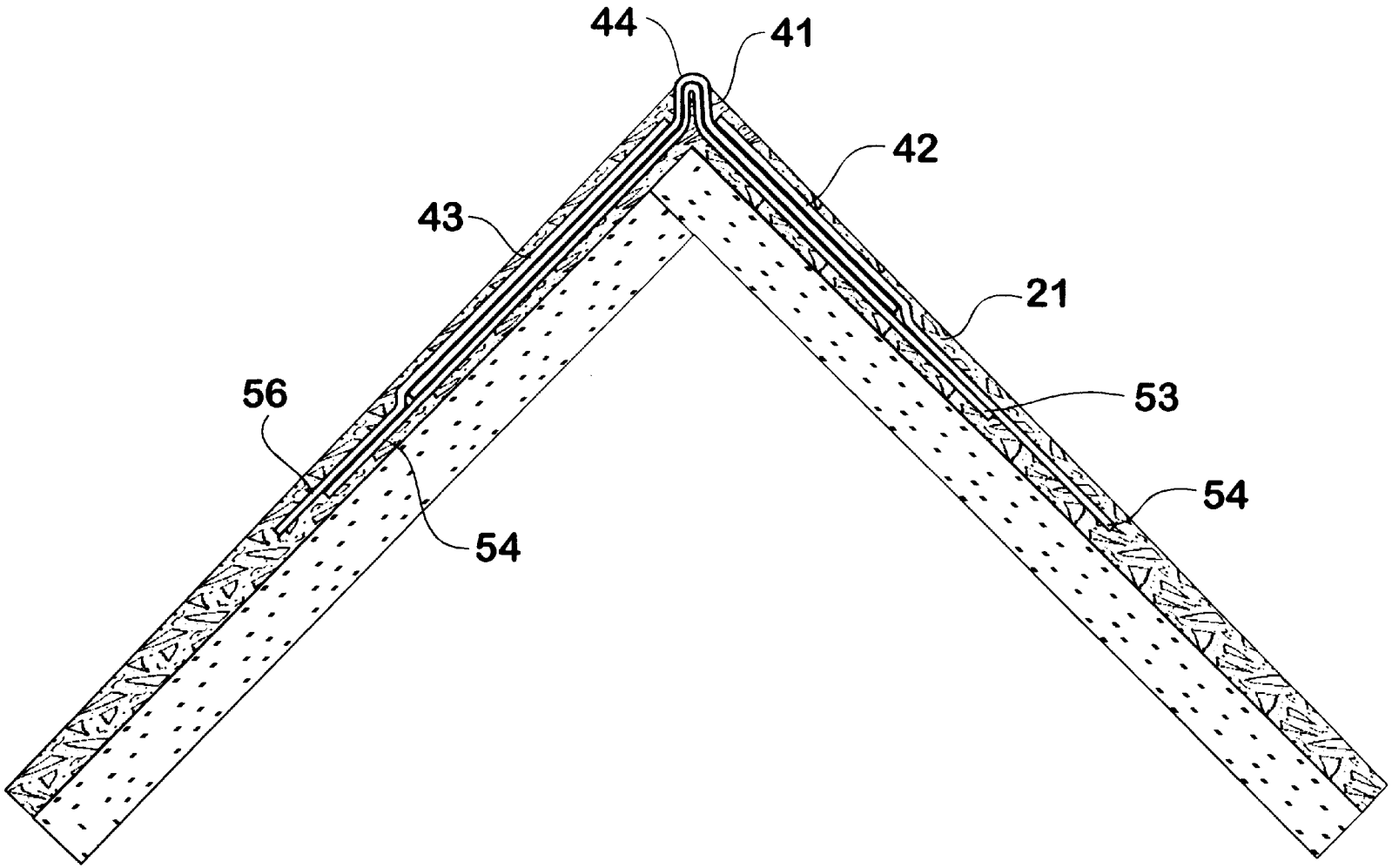
FIG. 6 is a sectional end view of the external corner bead of FIG. 5 in an in-use position.

A pre-fabricated external corner bead 40 is illustrated in FIG. 5 and adapted for attachment to an external wall corner as illustrated in FIG. 6. The external corner bead 40 is provided with a body structure 44 forming a reference bead 41 and offset flanges 42 and 43 extending from opposite sides of the reference bead 41 and offset from the outer or reference face 16. The body structure 44 is formed from any suitable metal or plastics material.

A paper layer 45 is bonded to the back face 46 of the body structure 44 and extends from an edge 53 across the flanges 42 and 43 and reference bead 41 to edge 55. Respective front paper layers 54 and 56 are bonded to the front faces of flanges 42 and 43 and extend from their junction with the reference bead 41 to and beyond the respective edges 53 and 55 of the back paper layer 45. Both the flanges 42, 43 and the paper layers 45, 54 and 56 are free of perforations.

In use, plaster filling compound 21 is applied either by hand to the plaster board 58 or by an applicator to the corner bead 40 which is placed with its back face against the plaster board 58. Suitably a bead roller is then rolled over the corner bead to bed the corner bead 40 into the filler 21 so as to bond it to the plaster board. A finishing knife or the like is used as previously described to complete the fixing of the corner bead, leaving the outer face 16 of the metal or plastics reference bead 41 exposed.

The remaining embodiments of FIGS. 7 to 12 illustrate various configurations of internal and external corner beads having features in common with the embodiment of FIG. 5.

In all these embodiments the elongate reference bead assembly provides, in the case of an external corner, a central reference face which is not covered by paper and along which a knife or scraper or the like may be slid for forming a straight continuous filled face at either front side thereof.

Figure 7:
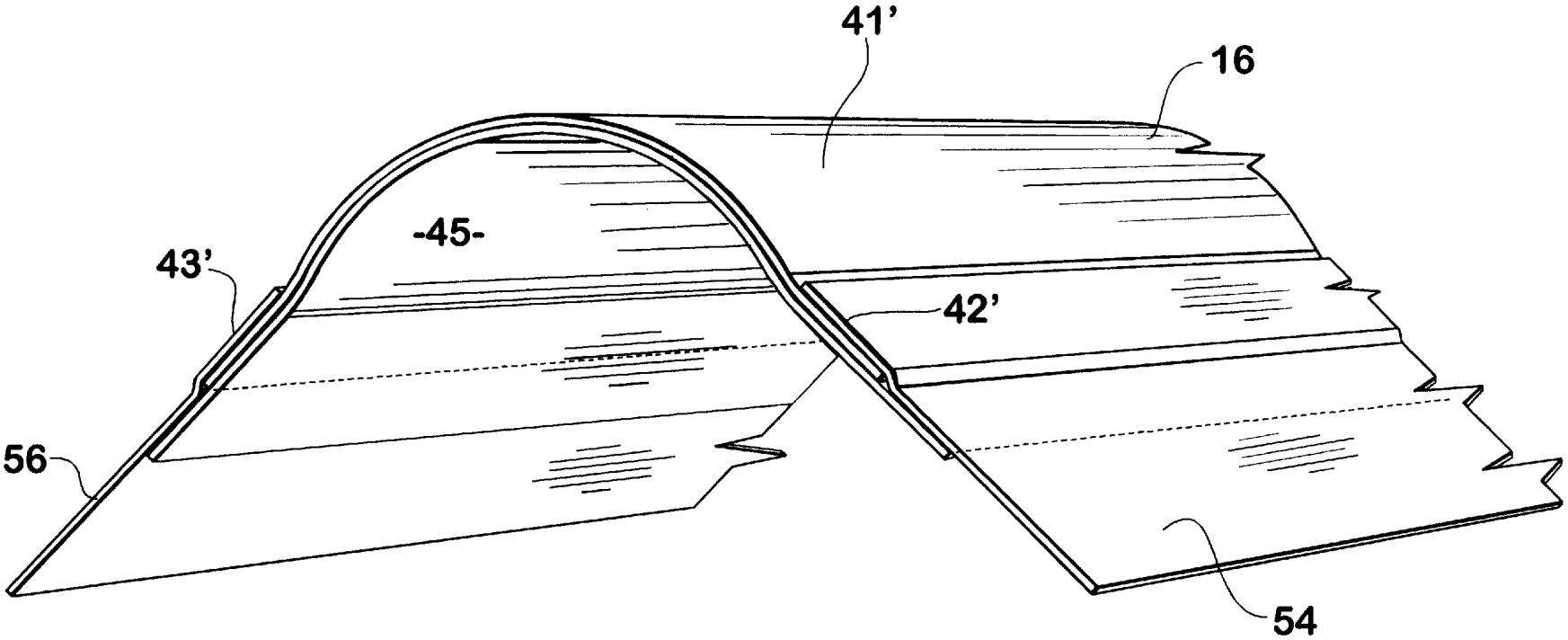
FIG. 7 is a perspective view of A "bullnose-type" corner bead for an external corner.
Figure 8:
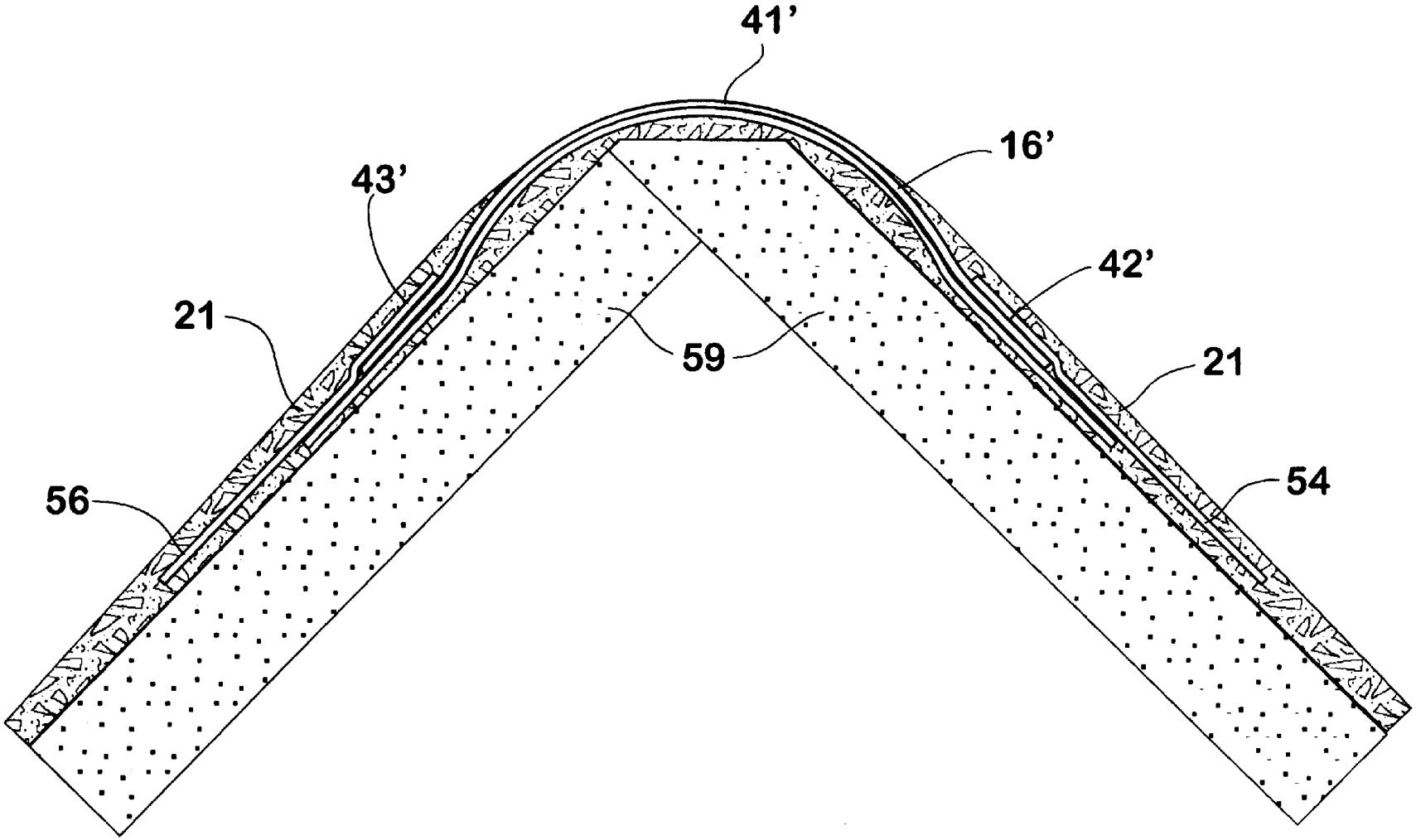
FIG. 8 illustrates the application of the "bullnose-type" external corner bead of FIG. 7.

In the case of external corner beads illustrated in FIGS. 7 and 8 the elongate reference bead 41' provides a central reference face 16 which is not covered by paper and along which a knife or scraper or the like may be slid for forming a straight continuous filled face at either front side thereof and the integral flanges 42' and 43' are rearwardly offset from the central reference face 16 at either front side thereof so that they may be readily concealed in the filling compound 21 filled to the reference face 16 and feathered back to the respective wall panels 59.

The rear layer of paper 45 is adhered to the front layers 54 and 56 and to the rear faces of the reference bead 41' and offset flanges 42' and 43'. In use the rear layer spans the joint between the wall panels 59 and provides a wide bonding face for effective bonding of the corner bead to the panels 59.

Figure 9:
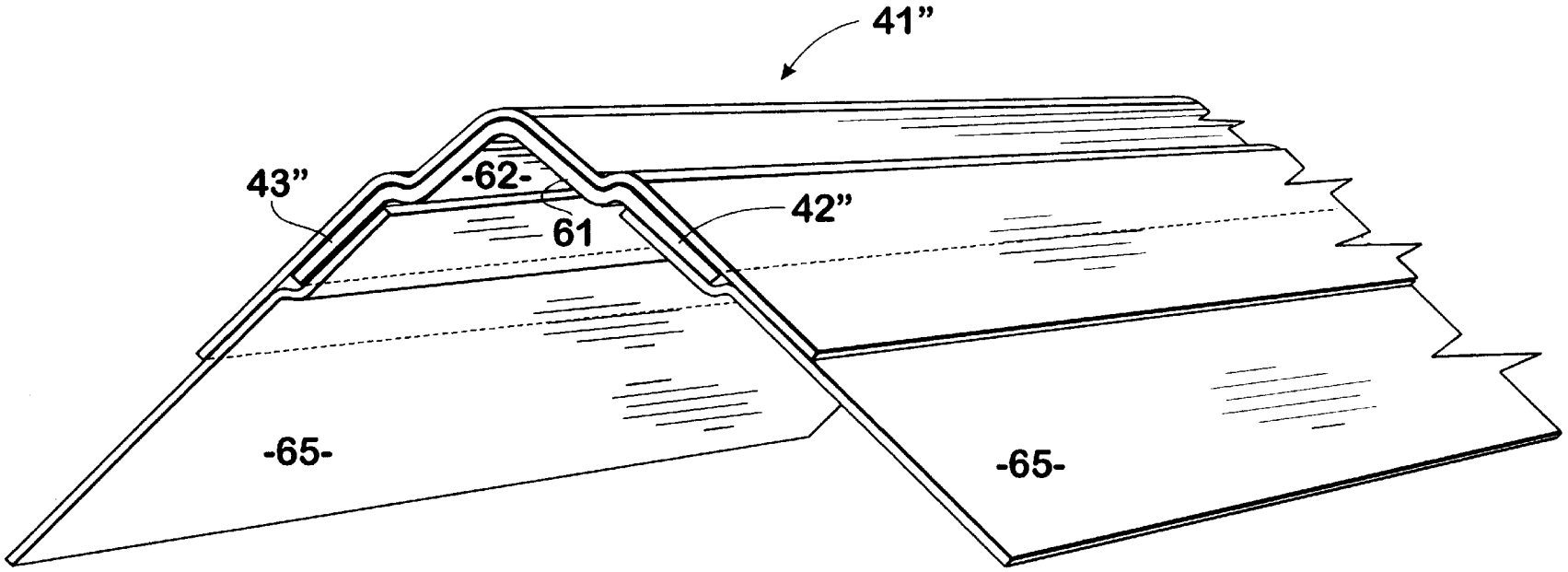
FIGS. 9 and 10 illustrate a corresponding internal "bullnose-type" corner bead.
Figure 10:
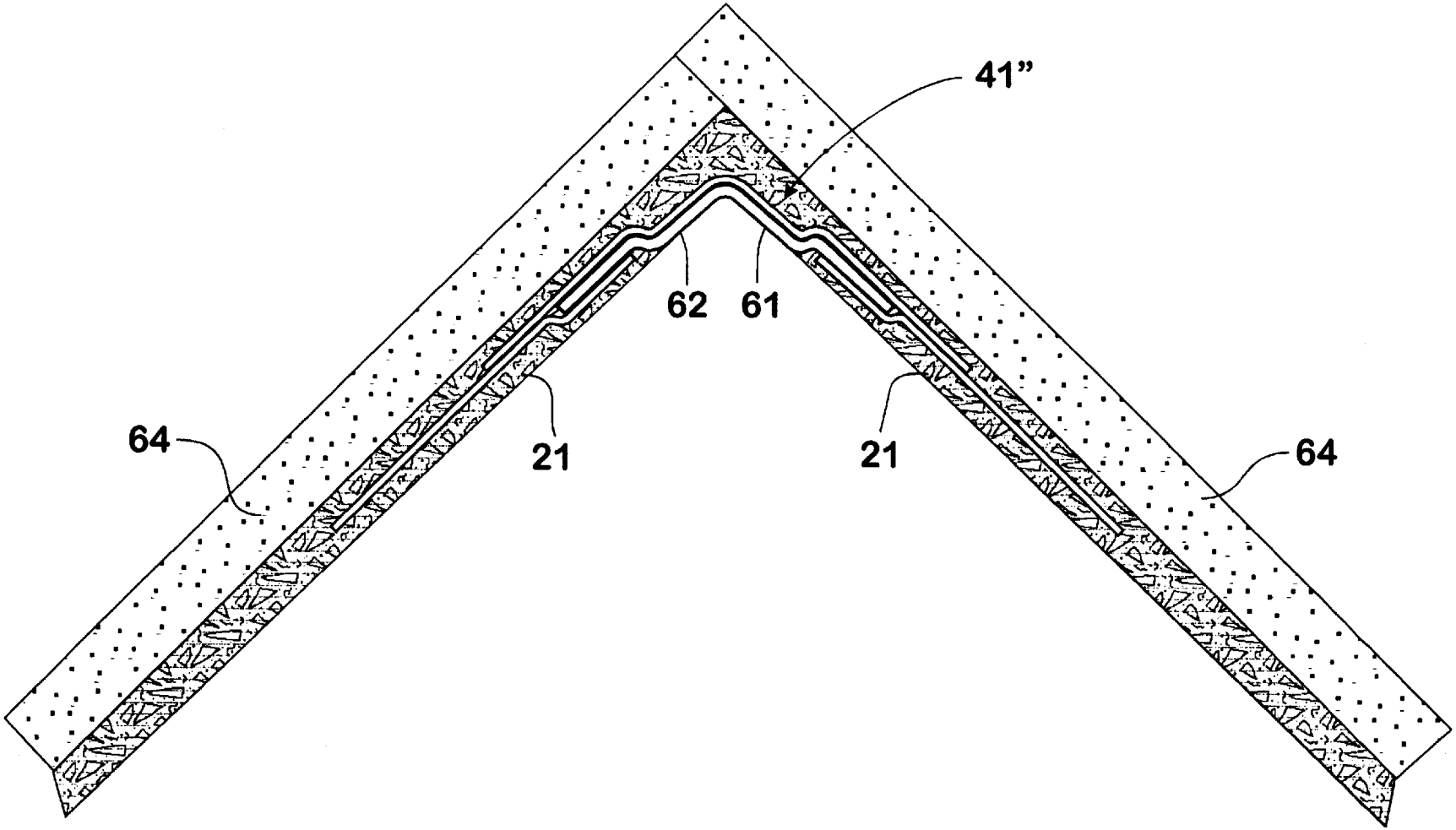
Figure 11:
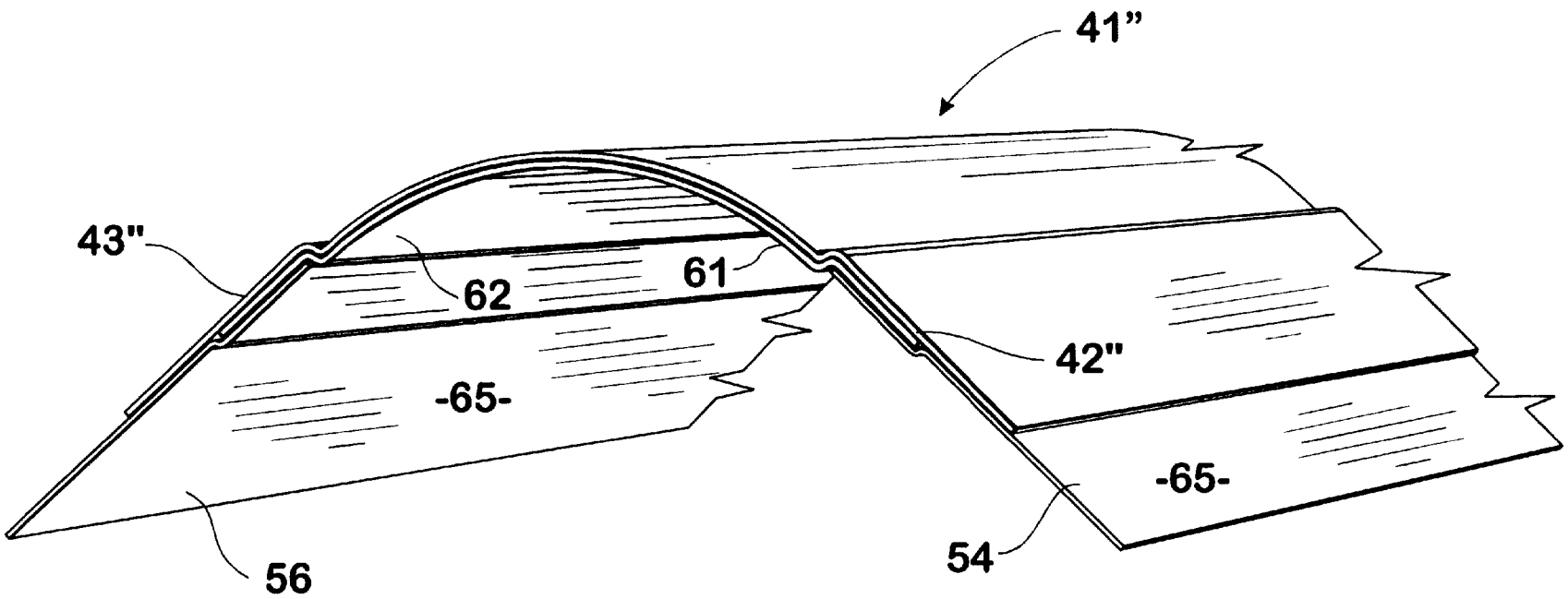
FIGS. 11 and 12 illustrate a standard type internal corner bead.

Likewise in the case of internal corner beads illustrated in FIGS. 9 to 11 the elongate reference bead assemblies 41" provide opposed reference faces 61 and 62 which join to form an internal corner and which are not covered by paper. Thus they provide hard surfaces along respective ones of which a knife or scraper or the like may e slid for forming a straight continuous filled flat face at either front side thereof.

The integral flanges 42" and 43" are rearwardly offset from the respective reference faces 61 and 62 at either front side thereof so that they may be readily concealed in the filling compound 21 filled to the respective reference face 61 and 62 and feathered back to the wall panels 64.

In each corner bead embodiment the respective front layers of paper material 54 and 56 extend beyond the rear paper layer to form thin flexible side panels 65 which may be readily conformed and adhered to the wall panels to facilitate ease of application and continuity of finish.

In the internal corner bead illustrated in FIG. 9 adapted for a right angle corner, it is preferred that the angle at the junction of the reference faces 61 and 62 is not the conventional 90° but is approximately 96/97°. This is done to facilitate use of a 75 mm to 100 mm wide finishing knife in order to provide a neater, smoother and more accurate finish.

The embodiment 70 illustrated in FIGS. 13 to 16 utilises an elongate body structure 71 extruded from a PVC plastics material and having thin central section 72 formed by a rear recess 73 and a front V-notch 74 separating opposed reference beads 75 which extend outwardly to rearwardly offset flanges 76 and 77.

As in the earlier corner bead embodiments a rear-layer of paper 45 is adhered to front layers 54 and 56, which extend across the front of respective flanges 76 and 77, and to the rear faces of the body structure 71. The front faces 78 of the opposed reference beads 75 are exposed. As in the previous embodiments the respective front layers of paper material 54 and 56 extend beyond the rear paper layer 45 to form thin flexible side panels 65 which may be readily conformed and adhered to the wall panels to facilitate ease of application and continuity of finish.

Figure 12:
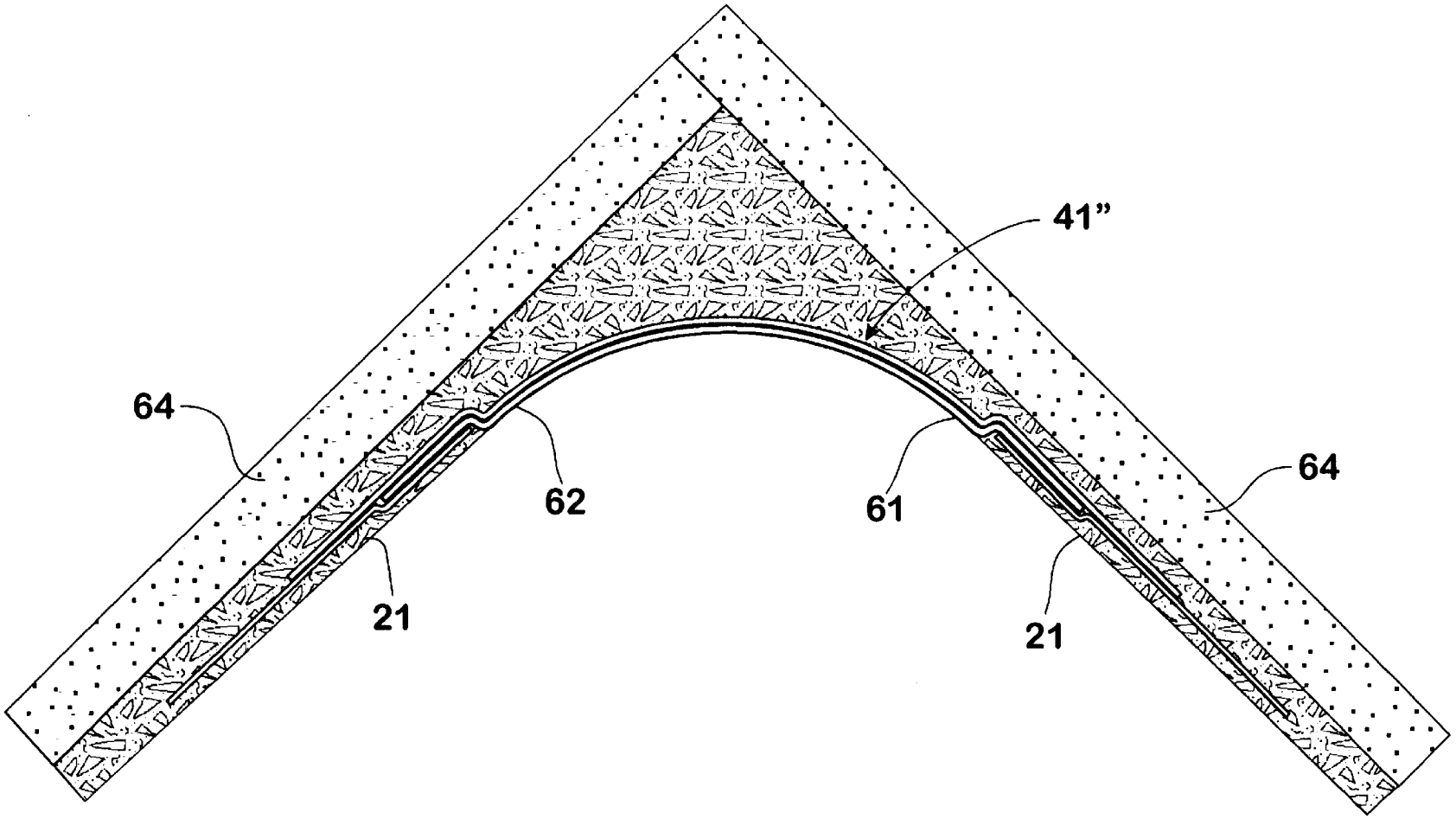
Figure 13:
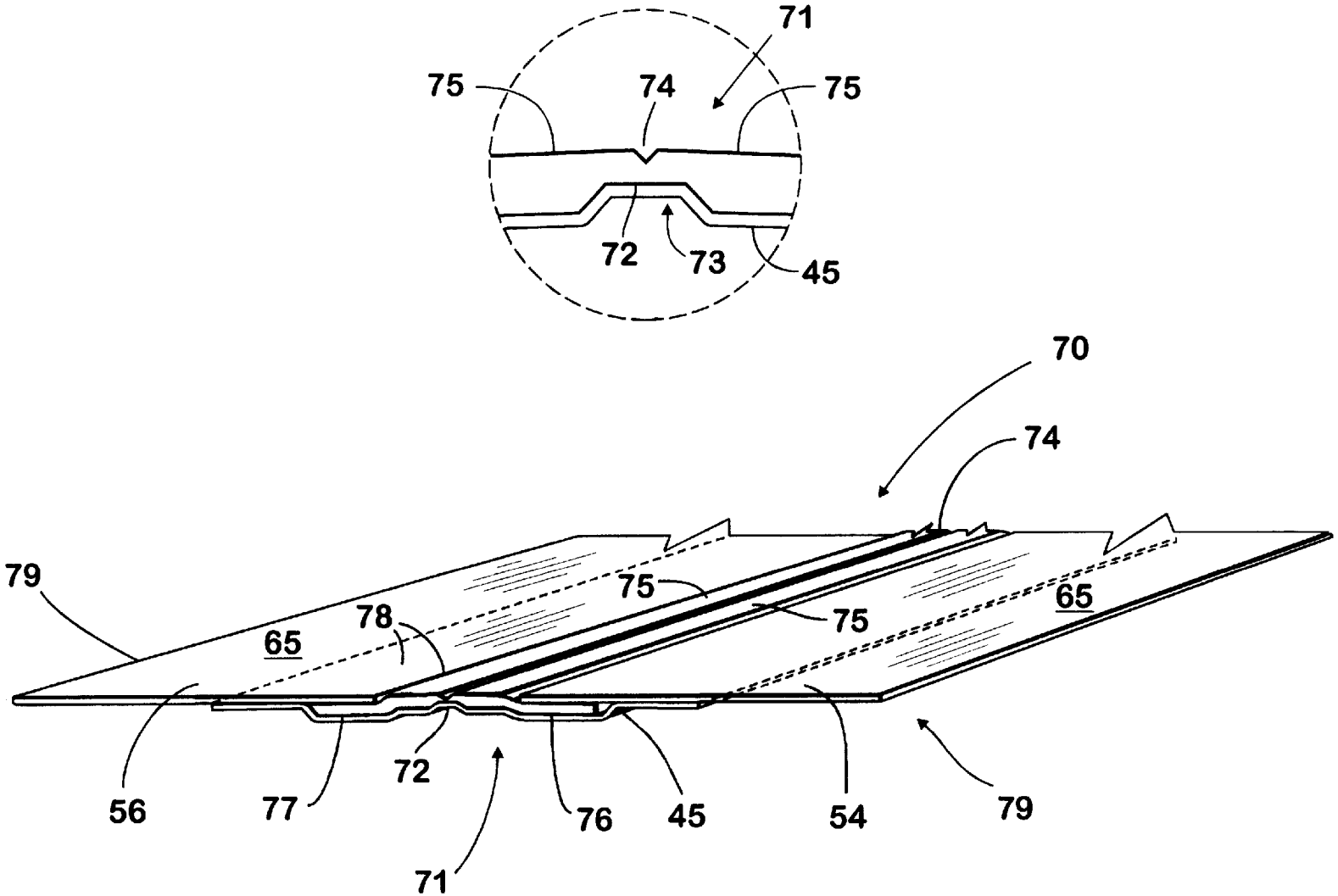
FIG. 13 illustrates yet another embodiment of this invention.
Figure 14:
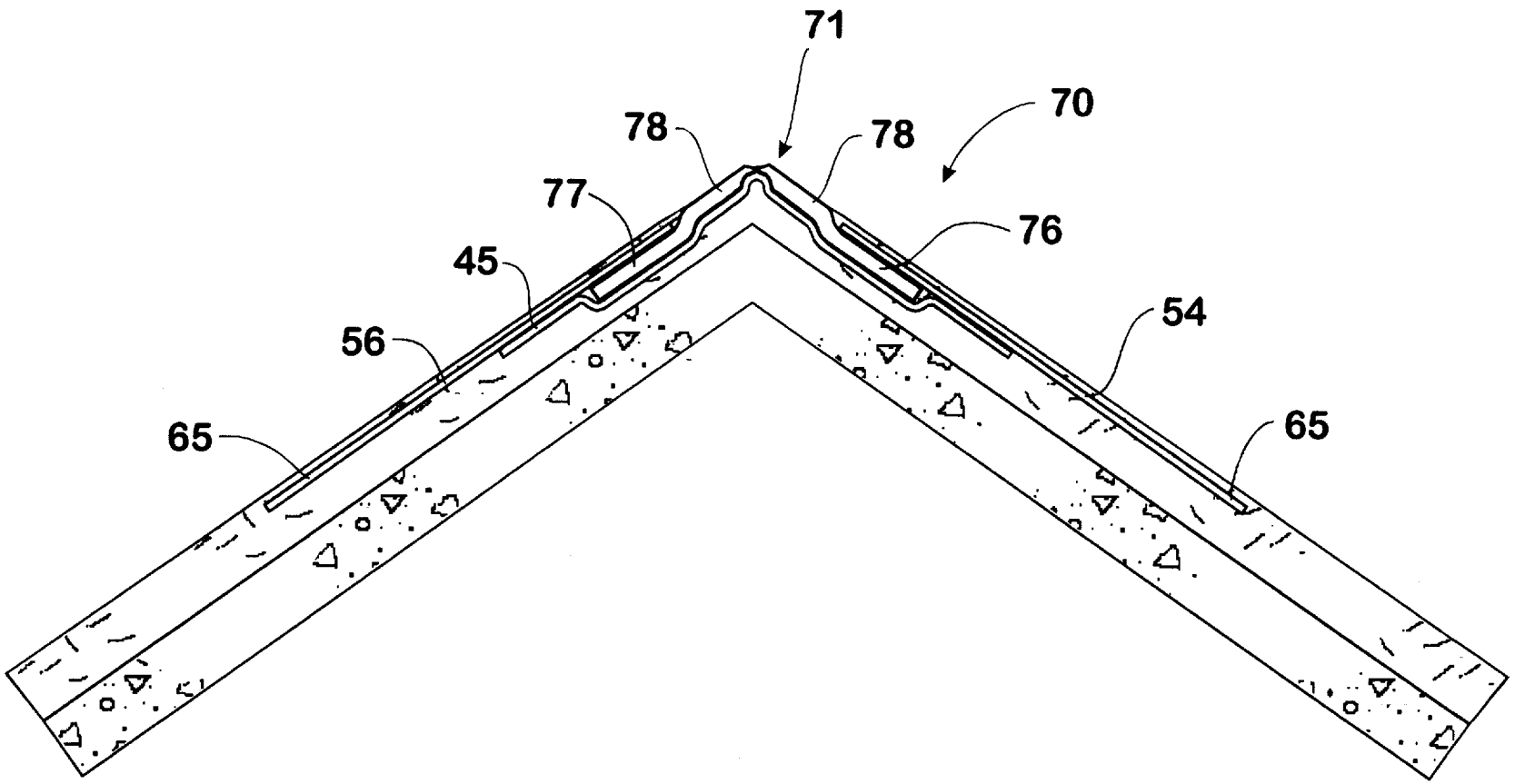
FIGS. 14 and 15 illustrate the application of the embodiment o FIG. 13 to internal and external corners.
Figure 15:
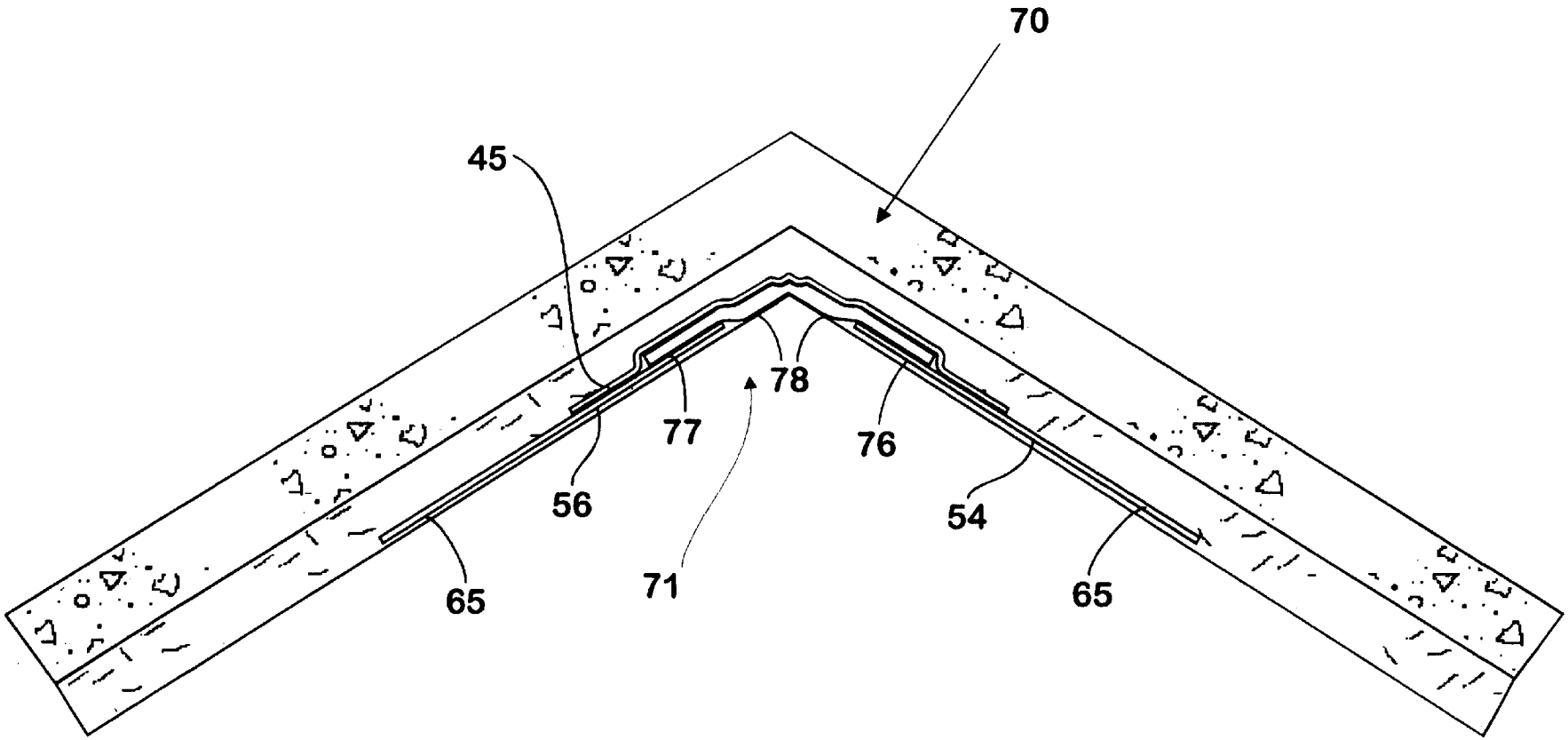

In use the elongate body structure 71 may be formed as a substantially flat body assembly 71 and in-line paper flange extension 79 as illustrated in FIG. 12. This embodiment may be sufficiently flexible to enable it to be roll up to form a compact package for transport and storage.

Figure 16:
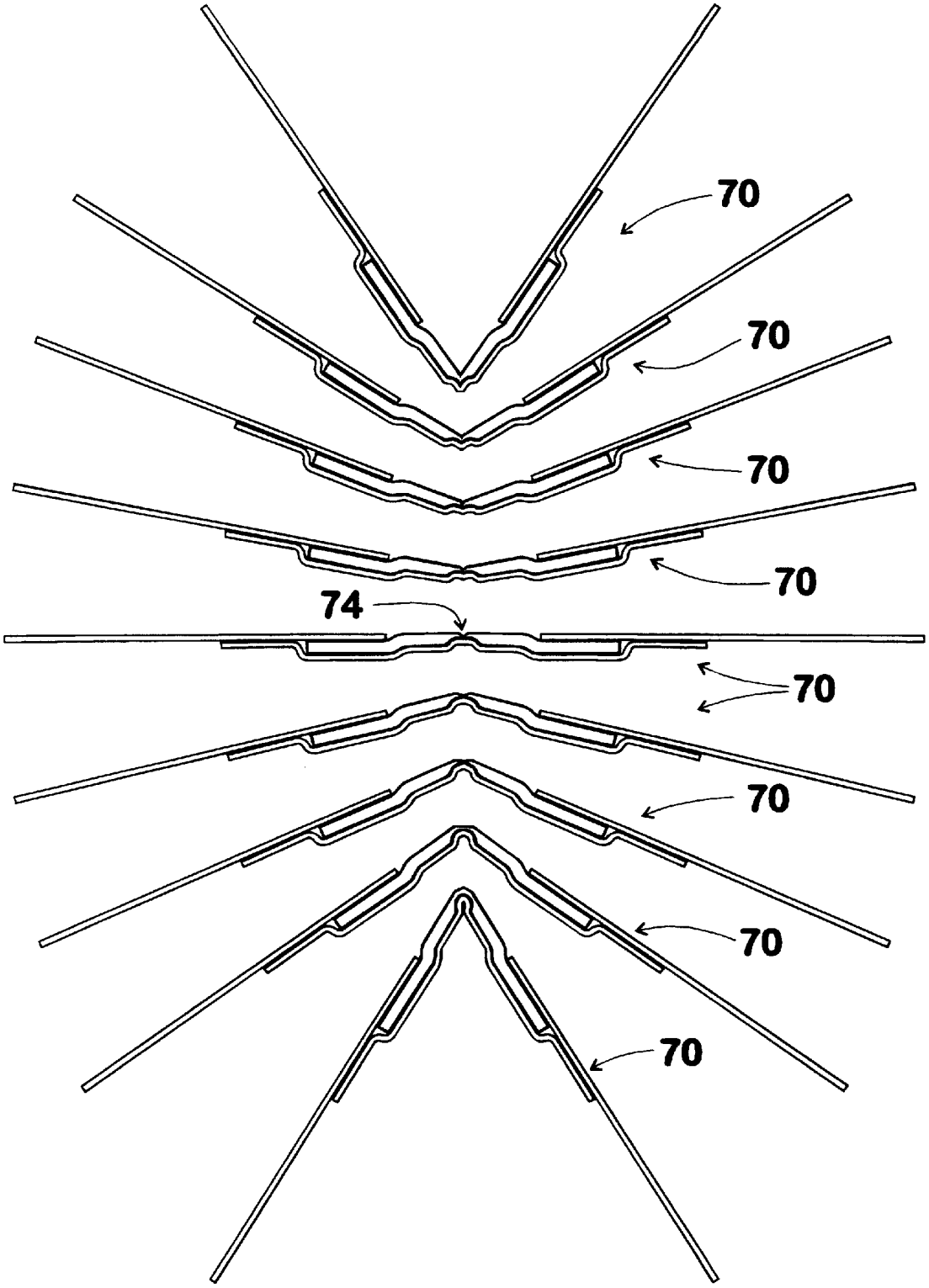
FIG. 16 illustrates the range of adjustment of the embodiment illustrated in FIG. 13, and FIGS. 17, 18 and 19 illustrate an expansion joint embodiment of the invention.

As shown in FIG. 16 this embodiment may be deformed about the hinge line formed by the V-notch 74 to form internal or external corner beads of various included angles.

The corner beads of the above embodiments are relatively speedily and easily applied. They alleviate the problems associated with the use of nails and perforations in the flanges and/or paper. They provide relatively full and secure bonding by having paper covering the entire bonding area. They provide a high quality finishing line or reference surface due to the front layers of paper being bonded to both outer flanges and by leaving the outer or front face of the metal or plastics reference bead assembly exposed. By extending the paper beyond one or both flanges they avoid the problem of wavy edges produced when nailing perforated flanges for example.

Figure 17:
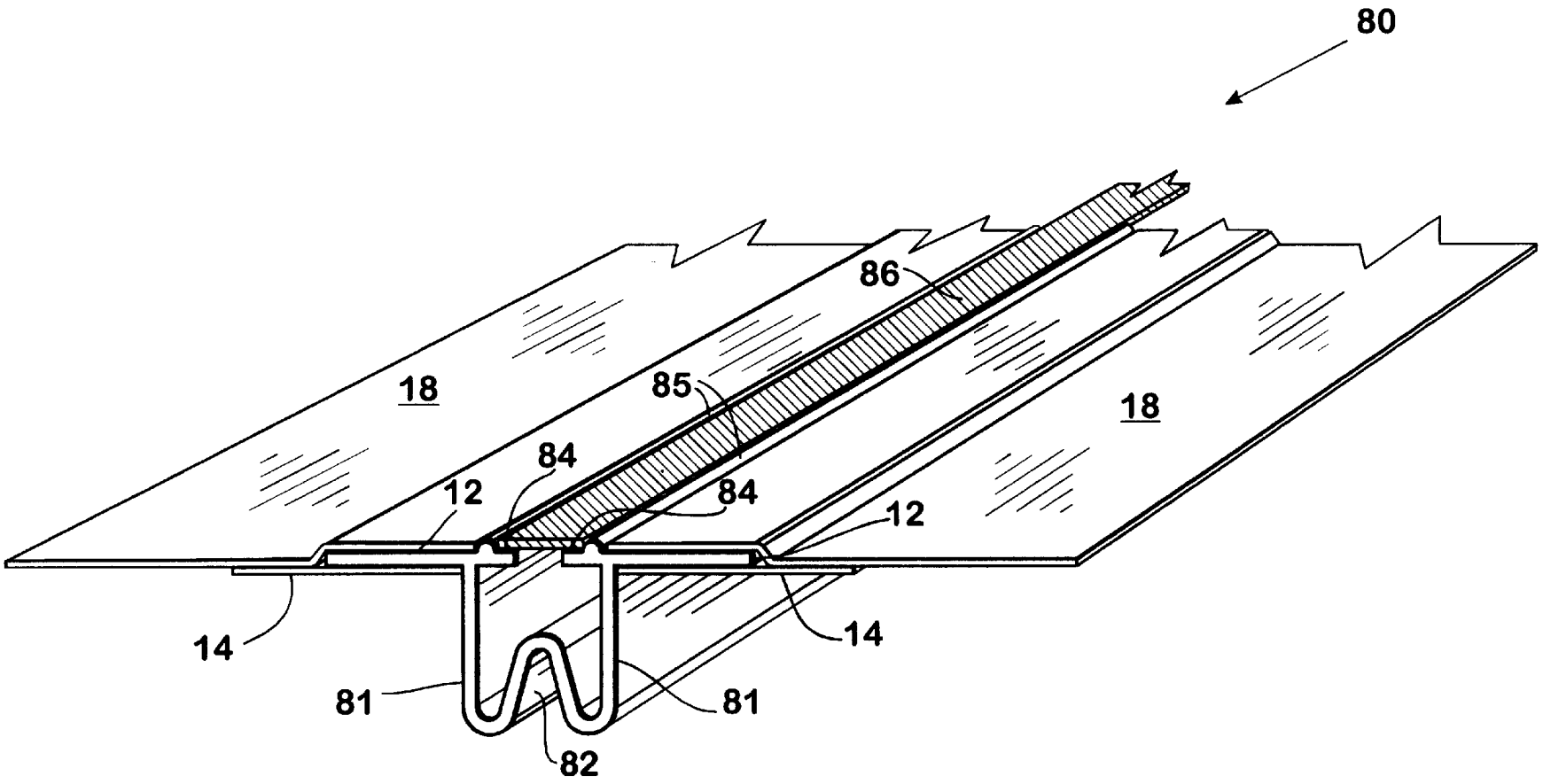
Figure 18:
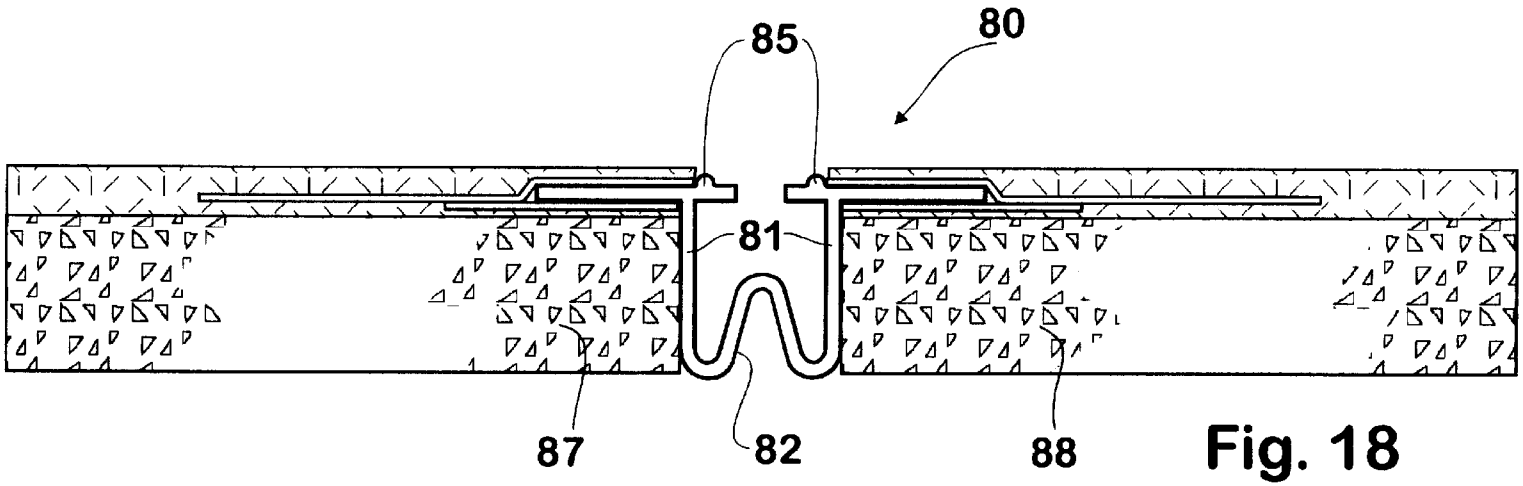
Figure 19:
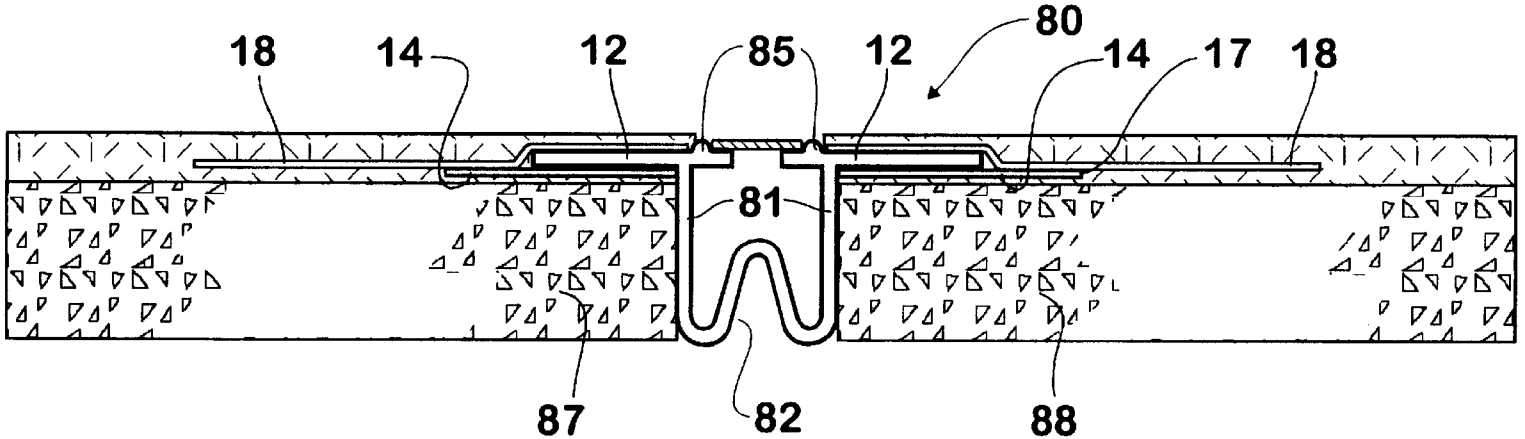

The expansion joint edge bead assembly 80 illustrated in FIGS. 17 to 19 maintains the features described with reference to the edge bead assembly of FIGS. 1 and 2. However in this embodiment the return flanges 81 are interconnected by a bellows type wall 82 to enable movement of the flanges 81 to and from one another.

In addition an internal ledge 84 is provided inwardly of each reference bead 85 and offset rearwardly therefrom and on which a sealing tape 86 may be set to span the gap between the return flanges 81 during fixing of the edge bead assembly 80 to the wall panels 87 and 88. This tape 86 is suitably removed prior to painting or finishing of the prepared wall.

It will of course be realised that whilst the above has been given by way of illustrative examples of the invention, all such and other modifications and variations hereto, as would be apparent to persons skilled in the art, are deemed to fall within the broad scope and ambit of the invention as is defined in the appended claims.

I claim:

1. A corner bead assembly for mounting across a corner of a wall, the assembly including:

a substantially rigid elongate body including a longitudinal reference bead and two rigid flanges extending outwardly away from the reference bead at an angle relative to each other, the flanges being offset rearwardly from the reference bead, and each flange having a front and rear face and extending from the reference bead to a terminal edge forming a side of the body;

a front layer of flexible material mounted over at least part of the front face of each flange and extending outwardly beyond the terminal edges of the flanges but leaving the reference bead exposed;

a rear layer of flexible material mounted over at least part of the rear face of each flange and extending outwardly beyond the terminal edges of the flanges where it overlaps with the front later of flexible material; and adhesive for adhering the front and rear layers of flexible material beyond the terminal edges of the flanges to each other, and also for adhering the front and rear layers of flexible material to the front and rear faces of the flanges.

2. A corner bead assembly according to claim 1, wherein the front layer of flexible material extends laterally outwardly beyond the rear layer of flexible material.

3. A corner bead assembly according to claim 2, wherein the front layer includes wide flexible portions extending outwardly beyond the terminal edges of the body.

4. A corner bead according to claim 1, wherein the rear layer of flexible material extends substantially fully across the rear face of each flange.

5. A corner bead assembly according to claim 1, wherein the front layer of flexible material extends substantially fully across the front face of each flange.

6. A corner bead assembly according to claim 1, wherein each of the front and rear layers of flexible material is made of a cellulosic material, and the body is made of a rigid plastic or metal material.

7. A corner bead assembly according to claim 1, wherein said flanges extend outwardly substantially transversely to each other.

8. A corner bead assembly according to claim 7, wherein one said flange extends substantially perpendicularly to the other said flange.

9. A corner bead assembly according to claim 1, wherein said adhesive is applied over substantially the entire area of the front and rear layers of flexible material, the adhesive being applied to the inwardly directed faces of said front and rear layers.

10. A corner bead assembly according to claim 1, wherein one of the layers of flexible material has its terminal edges spaced away from the terminal edges of the body, and the other layer of flexible material has its terminal edges spaced outwardly away from the terminal edges of said one layer of flexible material.

* * * * *